US006519965B1

(12) United States Patent
Blanchard, Sr. et al.

(10) Patent No.: US 6,519,965 B1
(45) Date of Patent: Feb. 18, 2003

(54) EXTERNALLY ILLUMINATED COOLER BOX

(76) Inventors: Daniel R. Blanchard, Sr., 162 Porter Pl., Rutland, VT (US) 05701; Craig M. Bania, P.O. Box 6173, Rutland, VT (US) 05702

( * ) Notice: Subject to any disclaimer, the term of this patent is extended or adjusted under 35 U.S.C. 154(b) by 0 days.

(21) Appl. No.: 10/060,212

(22) Filed: Feb. 1, 2002

(51) Int. Cl.[7] ..... F25D 27/00
(52) U.S. Cl. ..... 62/264; 62/457.7; 362/154
(58) Field of Search ..... 62/264, 457.7; 362/154, 155

(56) References Cited

U.S. PATENT DOCUMENTS

| | | | |
|---|---|---|---|
| 867,317 | A | 10/1907 | Stevenson |
| 1,895,864 | A | 1/1933 | Ricci |
| 2,145,196 | A | 1/1939 | Biggs |
| 2,604,579 | A | 7/1952 | Deneboudes |
| 2,644,882 | A | 7/1953 | Voda |
| 2,655,419 | A | 10/1953 | Achs |
| 3,937,320 | A | 2/1976 | Chao et al. |
| 4,238,934 | A | 12/1980 | Hotta |
| 4,498,312 | A | 2/1985 | Schlosser |
| 4,571,740 | A | 2/1986 | Kirby et al. |
| 4,667,484 | A | 5/1987 | Tarozzi et al. |
| 4,719,765 | A | 1/1988 | Hooper et al. |
| 4,939,912 | A | 7/1990 | Leonovich, Jr. |
| 5,007,246 | A | 4/1991 | Kruck et al. |
| 5,329,433 | A | 7/1994 | Greeting et al. |
| 5,768,898 | A | 6/1998 | Seok et al. |
| 6,182,462 | B1 | 2/2001 | Bania et al. |

*Primary Examiner*—William E. Tapolcai
(74) *Attorney, Agent, or Firm*—John J Welch, Jr., Esq.

(57) ABSTRACT

The instant invention is an insulated hollowed out cooler box with an insulated lid unit and with an external illumination system built into the frontal walling of the box which illumination system consists of a transparent plate covering a bulb filled with inert gas seated within the frontal walling with wiring affixed to the bulb leading to a manually operable switching unit and wiring leading therefrom to a terminal of a portable battery held within a compartment built into the frontal walling just behind where the bulb is seated and with wiring leading from the second terminal of the battery back to the bulb and with a cover plate serving to encase the battery within the compartment which said cover plate is affixable adjacent the switching unit in the top side of such frontal walling.

2 Claims, 3 Drawing Sheets

EXTERNALLY ILLUMINATED COOLER BOX

CROSS REFERENCES TO PRIOR OR PARENT APPLICATIONS

There are no prior or parent applications to which the instant invention relates.

FEDERALLY SPONSORED RESEARCH AND DEVELOPMENT

There is no federally sponsored research and development to which the instant invention relates.

BACKGROUND OF THE INVENTION

1. Field of the Invention

The instant invention relates to that category of portable devices which are utilized to temporarily store foods and beverages at cool temperatures.

2. Related Art

The Art Informational Statement herewith refers to art that however does not anticipate the instant invention.

A SUMMARY OF THE INVENTION

1. A Brief Description of the Invention

A first embodiment of the invention is a portable insulated, hollowed out cooler box equipped with a hingeably attachable insulated lid unit for temporarily storing foods and beverages at cool temperatures, within the frontal walling of which there is located a system serving to provide the box with external illumination. Such a system is similarly located within frontal walling of such a cooler box but with a removable lid for a second embodiment of the instant invention. The system consists of a bulb filled with an inert gas seated within such frontal walling behind a transparent plate screwed into such walling. Wiring affixed to a contact on the bulb runs to a manually operated switch from which other wiring runs to a terminal of a portable battery unit seated within a compartment built into the walling. A plate screwed into the top side of such frontal walling serves to hold the battery unit in place within the built-in compartment. The manually operated switch unit is also located about such top side of such frontal walling and is suitably connected as well to wiring leading to the other terminal of the battery unit from whence wiring leading back to another contact on the bulb facilitating the switching of the bulb on and off.

2. Object of the Invention

External illumination serves to provide the frontal exterior of a cooler box with a distinctively decorous aura that can serve to provide the box with a measure of aesthetic identity eminently pleasing to the owner thereof.

A DESCRIPTION OF THE DRAWINGS

A DESCRIPTION OF THE PREFERRED EMBODIMENTS

Figure 1:
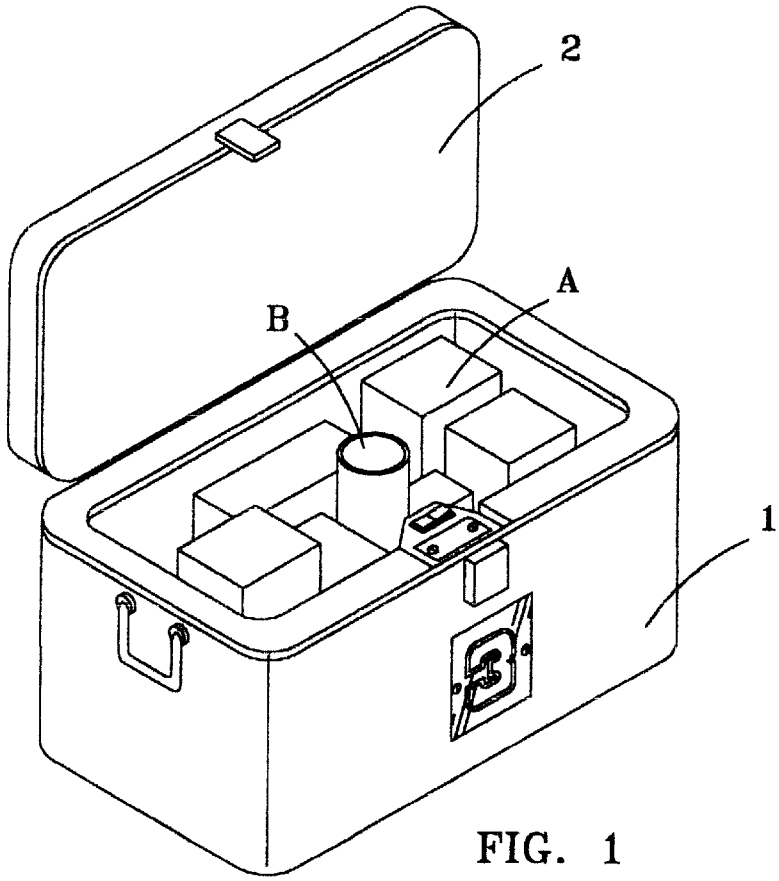
FIG. 1 is a perspective view of one embodiment of the instant invention.
Figure 2:
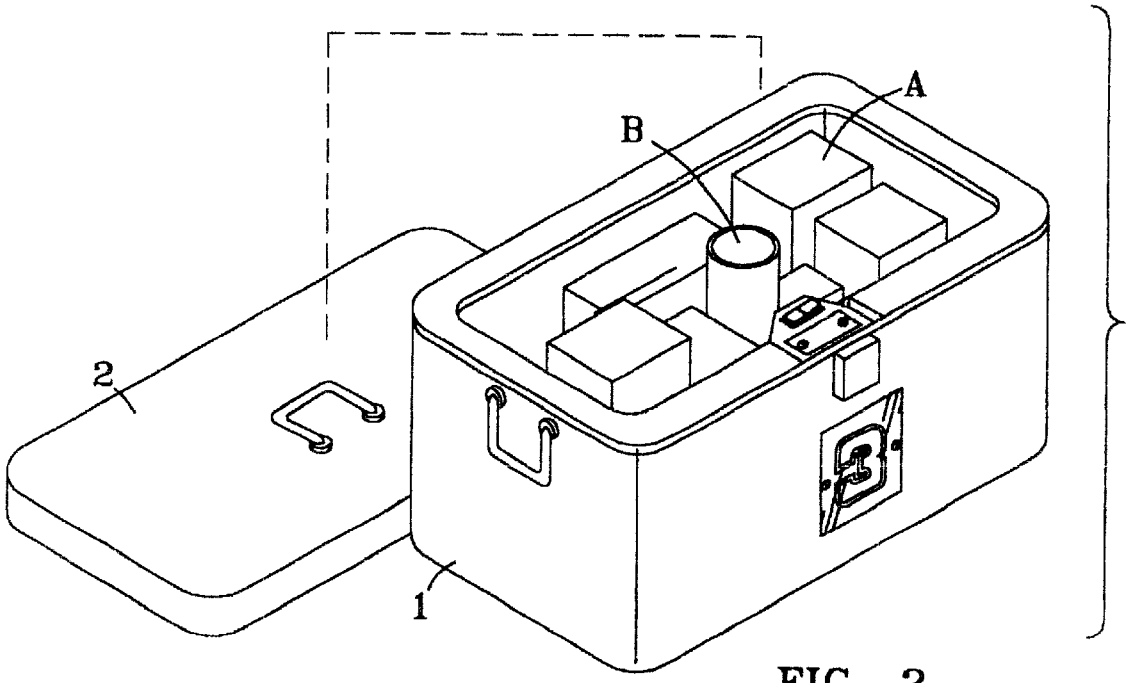
FIG. 2 is a perspective view of a second embodiment of the instant invention.
Figure 3:
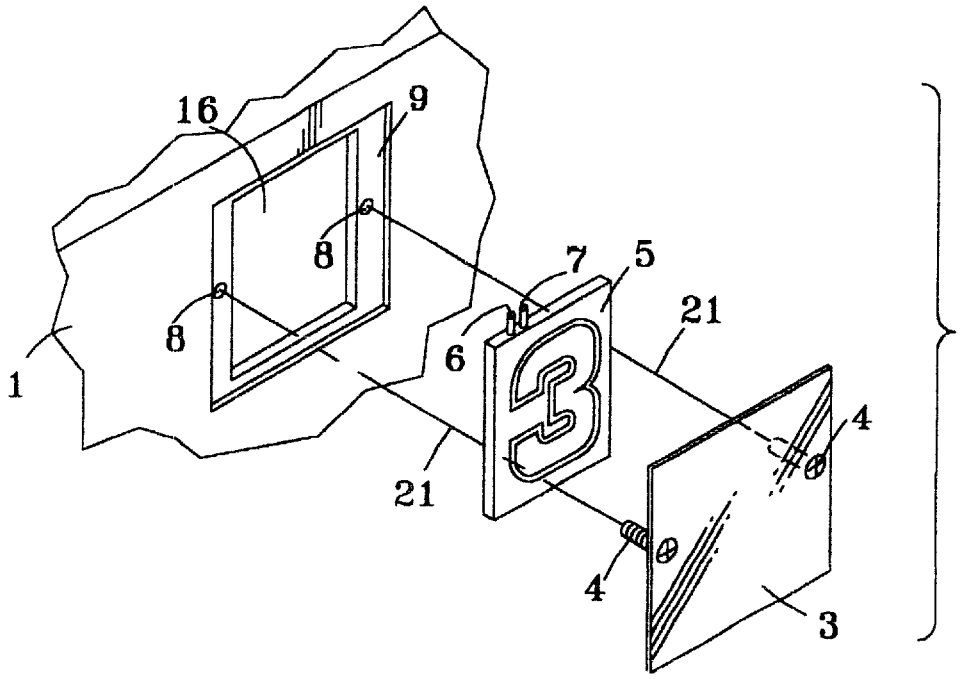
FIG. 3 is an exploded view of the visible components of the external illumination system of the instant invention.
Figure 4:
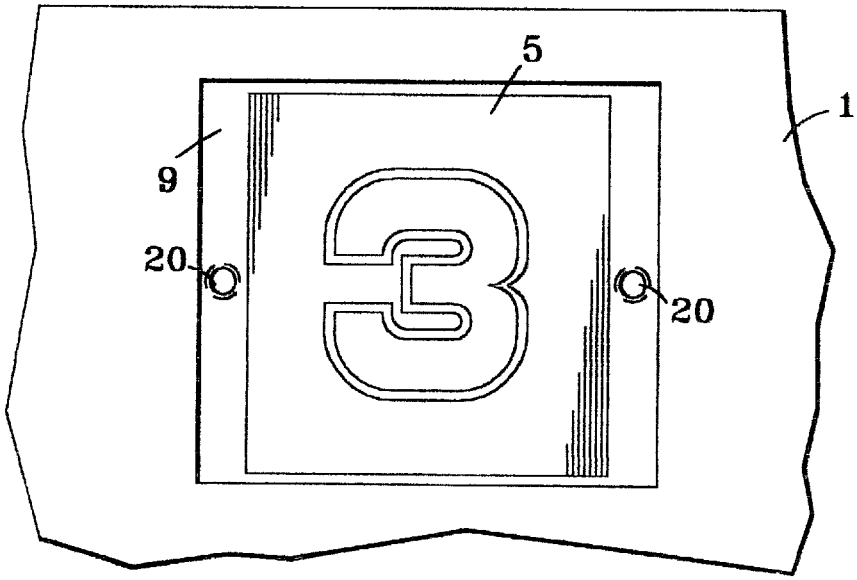
FIG. 4 is an isolated frontal view of the transparent plate and bulb components of the external illumination system.
Figure 5:
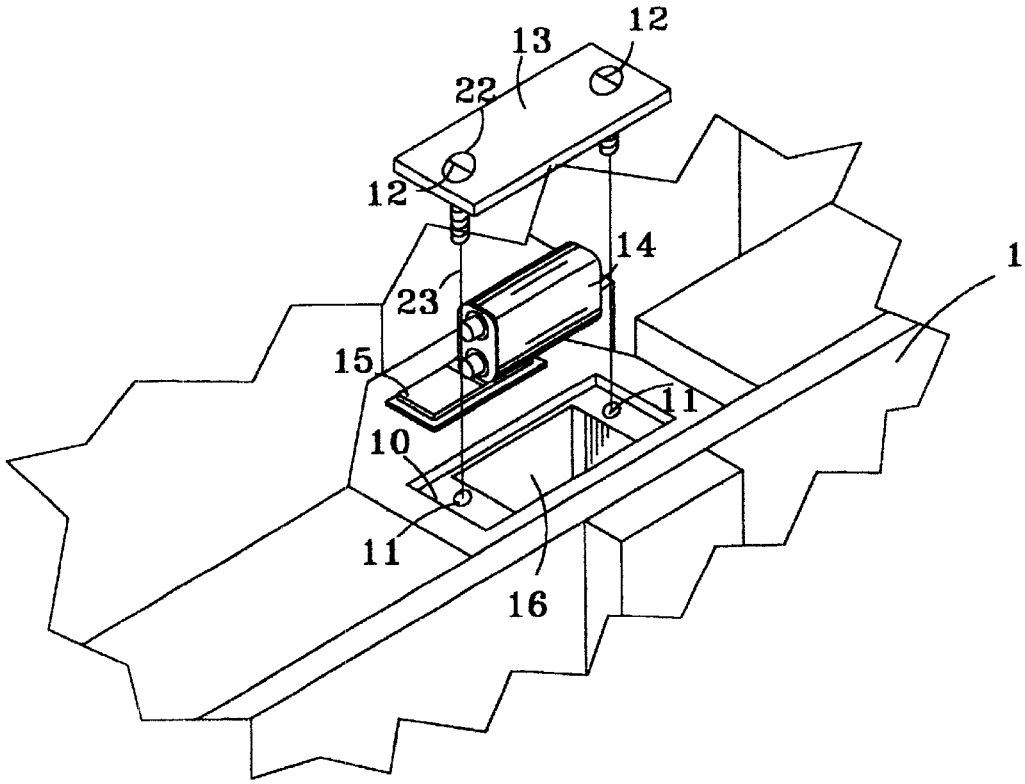
FIG. 5 is an exploded view of the battery component of the external illumination system in apposition to a protective cover plate and manually operable switch.
Figure 6:
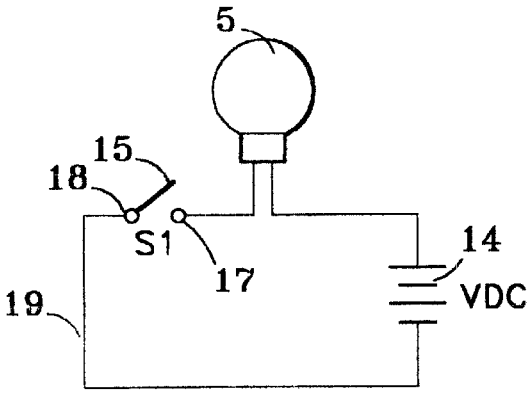
FIG. 6 is a schematic depiction of the circuitry endemic to the external illumination system with the manually operable switch component thereof in an off position.
Figure 7:
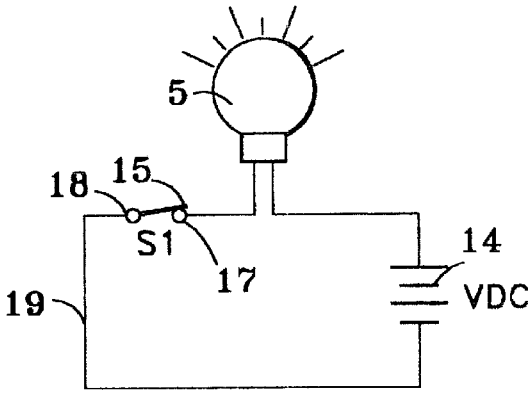
FIG. 7 is a schematic depiction of the circuitry endemic to the external illumination system with the manually operable switch component thereof in an on position.

FIG. 1 depicts in perspective view a first embodiment of the instant invention which is an insulated, hollowed out, portable food and beverage cooler box 1 with a hingeable attachable insulated lid unit 2 shown holding food A and beverage B and characterized by the presence of an external illumination system. FIG. 2 depicts a second embodiment of the instant invention characterized by the presence of an insulated lid unit 2 affixably to but removable from cooler box 1 as therein shown. FIG. 3 depicts the externally viable components of the illumination system. A transparent plate 3 serving to externally cover a bulb unit 5 filled with an inert gas such as neon is attachable by way of screws 4 into holes 8 found within a seating compartment 9 within the frontal walling of cooler box 1. Transparent plate 3 is screwed via a first pair of threaded screws 4 over bulb 5 one each into each one of a first pair of closed holes 8 to thereby serve to transparently hold bulb 5 in place within compartment 9. A first hole 8 is found within a first lateral aspect of compartment 9. A second hole 8 is found within a second lateral aspect of compartment 9. FIG. 4 shows bulb 5 in place within compartment 9 but without transparent plate 3 covering bulb 5. Near a first lateral edge of transparent plate 3 there is a first one of a first pair of through holes 20 and near a second lateral edge thereof is a second one of such a first pair of through holes 20. Each one of holes 20 is amenable to receipt of a threaded screw and each shares a common axis of symmetry 21 with each hole 8. FIG. 5 is an isolated exploded view showing portable battery unit 14 of the external illumination system. Battery unit 14 is held in place within compartment 5 cut into the frontal walling of cooler box 1 by way of battery compartment cover-plate 13 screwed into the top side of the frontal walling via a second pair of threaded screws 12 screwed one each into each one of a second pair of closed holes 11 within cover plate seating compartment 10 found in the top side of such frontal walling of cooler box 1. A first one of said second pair of closed holes 11 is in a first lateral aspect of compartment 10 and a second hole is in a second lateral aspect thereof. Each of a pair of through holes 22 is near a lateral edge of cover-plate 13 receiving one of threaded screws 12 and shares a common axis of symmetry 23 with each of closed holes 1. Switch 15 which is manually operable is also located in the top side of the frontal walling of cooler box 1. Compartment 16 is also seen in FIG. 3 and serves to facilitate passage of wiring 6 from bulb 5 through switch 15 to wiring 19 leading to one terminal of battery unit 14 back to bulb 5 when all components of the external illumination system are being held in place within such frontal walling. By manually operating switching unit 15, one is able to effect external illumination from the frontal walling of cooler box 1. Such external illumination can be as aesthetically pleasing as an owner of the externally illuminated cooler box may wish. Bulbs 5 can be reflective of virtually an endless array of design characteristics. FIGS. 6 and 7 schematically depict the circuitry endemic to the external illumination system. A first wire 6 leading from a contact point on bulb 5 is connected to a first contact 17 within switching unit 15 shown in the off position in FIG. 6. A second wire 19 leads from second contact 18 of switching unit 15 to one terminal of portable battery unit 14. Third wire 7 leads from the other terminal of battery unit 14 back to a second contact point on bulb 5 as shown in FIGS. 5 and 6. FIG. 7 shows switching unit 15 in the on position.

In conclusion, respectfully submitted, the above-described externally illuminated cooler box is new, unique and unquestionably useful from at least, decorous vantage point.

What is claimed is:

1. an externally illuminated cooler box, comprising:

a. an insulated, hollowed out cooler box;

b. an insulated lid unit hingeably attached to said cooler box;

c. a seating compartment cut into frontal walling of said cooler box;

d. a first pair of closed holes for receipt by each one of said pair of closed holes of a threaded screw;

e. a first one of said first pair of closed holes being cut into and located within a first lateral aspect of said seating compartment;

f. a second one of said first pair of closed holes being cut into and located within a second lateral aspect of said seating compartment;

g. a first pair of threaded screws receivable one each within each one of said first pair of closed holes;

h. a bulb unit filled with an inert gas;

i. a first wire affixed to a first contact found on said bulb unit;

j. a second wire affixed to a second contact found on said bulb unit;

k. a transparent plate characterized by a presence of a first pair of through holes, a first one of said first pair of through holes being near a first lateral edge of said transparent plate, and a second of said first pair of through holes being near a second lateral edge of said transparent plate;

l. each one of said first pair of through holes being amenable to receipt of one of said first pair of threaded screws and each said one of said first pair of through holes sharing a common horizontal axis of symmetry with each one of said first pair of closed holes;

m. said transparent plate being positioned exterior to said bulb unit when said transparent plate and said bulb unit are held via said first pair of threaded screws, received one each by said first pair of through holes, flush within said seating compartment as said threaded screws are screwed into and held one each within one each of said first pair of closed holes;

n. a battery compartment through hole cut into said frontal walling within the confine of said seating compartment;

o. a battery cover plate seating compartment cut into a top side of said frontal walling of said cooler box;

p. a second pair of closed holes for receipt by each one of said second pair of closed holes of a threaded screw;

q. a first one of said second pair of closed holes being cut into and located within a first lateral aspect of said battery cover plate seating compartment;

r. a second one of said second pair of closed holes being cut into and located within a second lateral aspect of said battery cover plate seating compartment;

s. a second pair of threaded screws receivable one each within each one of said second pair of closed holes;

t. a battery compartment cut through a top side of said front walling of said cooler box within the confines of said battery cover plate seating component and extending into said frontal walling down to a lever of said battery compartment;

u. a portable battery unit seated within said battery compartment; v. a battery compartment cover plate characterized by a presence of a pair of through holes, one of said second pair of through holes being near a first lateral edge of said battery compartment cover plate, and, a second one of said second pair is through holes being near a second lateral edge of said battery compartment cover plate, with each of said pair of through holes sharing a common vertical central axis of symmetry with each one of said second pair of closed holes;

w. said battery compartment cover plate covering said portable battery unit with said battery compartment lying flush within said battery cover plate seating compartment when each of said second pair of threaded screws received one each by each one of said second pair of through holes, is screwed into and held one each within one each of said second pair of closed holes;

x. a manually operable switch unit positioned near said top side of said frontal walling of said cooler box, adjacent said battery cover plate component;

y. a first wire leading from a contact on said bulb through said battery compartment through hole to a first contact on said switch;

z. a second wire leading from a second contact on said switch to a first terminal on said portable battery unit, and;

aa. a third wire leading from a second terminal on said portable battery unit through said battery compartment through hole to a second contact on said bulb.

2. An externally illuminated cooler box, comprising:

a. an insulated, hollowed out cooler box;

b. an insulated lid unit removably attachable to said cooler box;

c. a seating compartment cut into frontal walling of said cooler box;

d. a first pair of closed holes for receipt by each one of said pair of closed holes of a threaded screw;

e. a first one of said first pair of closed holes being cut into and located within a first lateral aspect of said seating compartment;

f. a second one of said first pair of closed holes being cut into and located within a second lateral aspect of said seating compartment;

g. a first pair of threaded screws receivable one each within each one of said first pair of closed holes;

h. a bulb unit filled with an inert gas;

i. a first wire affixed to a first contact found on said bulb unit;

j. a second wire affixed to a second contact found on said bulb unit;

k. a transparent plate characterized by a presence of a first pair of through holes, a first one of said first pair of through holes being near a first lateral edge of said transparent plate, and a second of said first pair of through holes being near a second lateral edge of said transparent plate;

l. each one of said first pair of through holes being amenable to receipt of one of said first pair of threaded screws and each said one of said first pair of through holes sharing a common horizontal axis of symmetry with each one of said first pair of closed holes;

m. said transparent plate being positioned exterior to said bulb unit when said transparent plate and said bulb unit are held via said first pair of threaded screws, received one each by said first pair of through holes, flush within said seating compartment as said threaded screws are screwed into and held one each within one n. a battery compartment through hole cut into said frontal walling within the confine of said seating compartment;

o. a battery cover plate seating compartment cut into a top side of said frontal walling of said cooler box;

p. a second pair of closed holes for receipt by each one of said second pair of closed holes of a threaded screw;

q. a first one of said second pair of closed holes being cut into and located within a first lateral aspect of said battery cover plate seating compartment;

r. a second one of said second pair of closed holes being cut into and located within a second lateral aspect of said battery cover plate seating compartment;

s. a second pair of threaded screws receivable one each within each one of said second pair of closed holes;

t. a battery compartment cut through a top side of said front walling of said cooler box within the confines of said battery cover plate seating component and extending into said frontal walling down to a lever of said battery compartment;

u. a portable battery unit seated within said battery compartment;

v. a battery compartment cover plate characterized by a presence of a pair of through holes one of said second pair of through holes being near a first lateral edge of said battery compartment cover plate, and, a second one of said second pair is through holes, being near a second lateral edge of said battery compartment cover plate, with each of said pair of through holes sharing a common vertical central axis of symmetry with each one of said second pair of closed holes;

w. said battery component cover plate covering said portable battery unit with said battery compartment lying flush within said battery cover plate seating compartment when each of said second pair of threaded screws received one each by each one of said second pair of through holes, is screwed into and held one each within one each of said second pair of closed holes;

x. a manually operable switch unit positioned near said top side of said frontal walling of said cooler box, adjacent said battery cover plate component;

y. a first wire leading from a contact on said bulb through said battery compartment through hole to a first contact on said switch;

z. a second wire leading from a second contact on said switch to a first terminal on said portable battery unit, and;

aa. a third wire leading from a second terminal on said portable battery unit through said battery compartment through hole to a second contact on said bulb.

* * * * *